United States Patent [19]

Galletto

[11] Patent Number: 4,554,848

[45] Date of Patent: Nov. 26, 1985

[54] INTERNAL PLIERS

[76] Inventor: Joseph L. Galletto, 4759 N. Maplewood, Apt. 108, Chicago, Ill. 60625

[21] Appl. No.: 644,575

[22] Filed: Aug. 27, 1984

[51] Int. Cl.[4] ..... B25B 7/14

[52] U.S. Cl. ..... 81/447; 81/318; 81/326; 81/395; 81/402

[58] Field of Search ..... 81/447, 442, 443, 326, 81/417, 395, 402, 318, 393

[56] References Cited

U.S. PATENT DOCUMENTS

| | | | |
|---|---|---|---|
| 1,317,399 | 9/1919 | Stoffel | 81/442 |
| 1,388,744 | 8/1921 | Morrissey | 81/442 |
| 1,534,066 | 4/1925 | Larkey | 81/447 |
| 1,676,775 | 7/1928 | Doherty | 81/443 |
| 2,740,196 | 4/1956 | Ehinger | 81/417 |
| 2,842,996 | 7/1958 | Coslow et al. | 81/402 |

FOREIGN PATENT DOCUMENTS

| | | | |
|---|---|---|---|
| 757522 | 10/1933 | France | 81/417 |
| 22578 | of 1893 | United Kingdom | 81/326 |

*Primary Examiner*—Frederick R. Schmidt
*Assistant Examiner*—J. T. Zatarga
*Attorney, Agent, or Firm*—James Benson

[57] ABSTRACT

A pair of pliers is equipped with an expander unit that spreads the handles so that the jaws will forcibly grip objects from the inside. External teeth on the jaws aid in gripping.

5 Claims, 7 Drawing Figures

INTERNAL PLIERS

BACKGROUND OF THE INVENTION

This invention relates to pliers.

There are a number of tasks encountered by servicemen, maintenance workers, machinists, etc., which would be made easier if an object could be gripped from the inside; but in general no tool has heretofore been available that would handle these tasks. Such tasks as removing the bases of broken light bulbs from corroded sockets, or removing the ends of broken sight glasses from their fittings, can prove quite difficult and time consuming. It is believed that a set of internal pliers such as described herein would be of utility in easing the handling of tasks requiring gripping of an object from the inside.

SUMMARY OF THE INVENTION

A pair of pliers is equipped with an expander unit that spreads the handles of the pliers, resulting in the jaws of the pliers being forcibly spread for internal gripping. The jaws are preferable fitted with external teeth or a serrated surface to aid in gripping. The pliers may be straight or bent nosed. The pliers may serve a dual function as internal or regular pliers, and have both external and internal teeth on the jaws.

Further features and benefits of the invention will be apparent from the following description with reference to the accompanying drawings.

DESCRIPTION OF THE PREFERRED EMBODIMENTS

Figure 1:
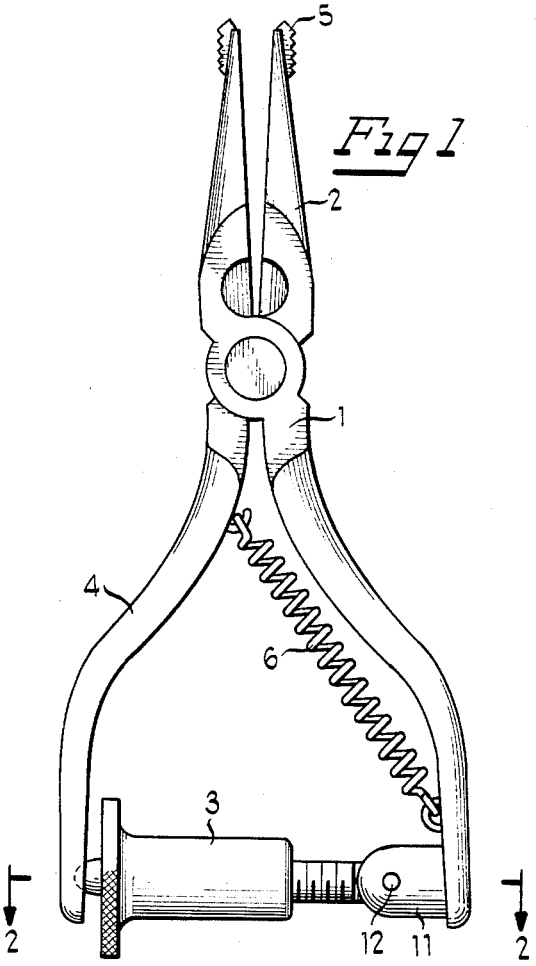
FIG. 1 is a side view of the internal pliers.

Referring to FIG. 1, pliers 1 have jaws 2 that are suited for internal grasping of objects having holes in them. By "pliers" in this application and claims is meant ordinary pliers of the type having two lever arms, each arm consisting of a jaw section and a handle section, crisscrossed at a pivot point located between the jaw and handle sections in such a manner that when the handles are squeezed the jaws close. Expander unit 3 is used to spread apart the handles 4 of the pliers to open the jaws. The jaws are preferably equipped with external teeth, such as teeth 5. A spring 6 is advisable to maintain tension between the pliers' handles in order that the handles remain in contact with the expander unit during operation of the tool.

Figure 3:
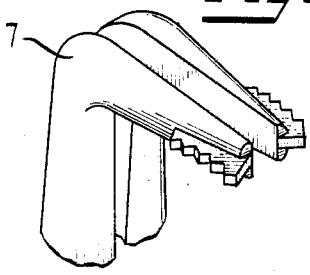
FIG. 3 shows a bent nosed variety of the invention.

The pliers may be of the bent nosed variety, as in FIG. 3, showing bent jaws 7.

Figure 4:
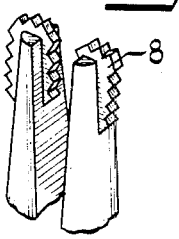
FIG. 4 shows both internal and external teeth on the jaws of a dual purpose pair of pliers.

Referring to FIG. 4, the pliers can be made having jaws with both internal and external teeth 8, so that the pliers can function both as internal pliers and as regular pliers.

Figure 2:
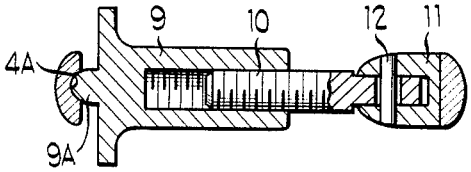
FIG. 2 is a cross-section of the expander unit and part of the pliers' handles, taken along line 2—2 of FIG. 1.
Figure 5:
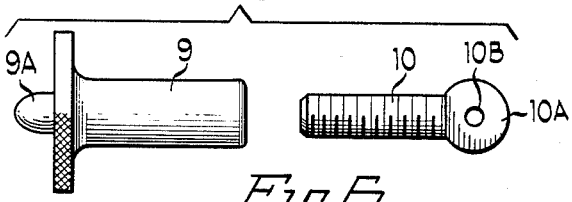
FIGS. 5–7 are variations of the expander unit, shown expanded in the drawings.

It can be seen in FIGS. 2 and 5 that the expander unit consists of internally-threaded thumbscrew 9 and threaded adjuster 10. Turning the thumbscrew results in spreading the handles of the pliers apart or bringing them together, as should be obvious.

Thumbscrew 9 has a rounded pin 9A on its end that engages a notch 4A in one handle, as is apparent in FIGS. 1 and 2. The other handle has a pin-yoke 11 attached to it through which pin 12 passes. The end 10A of adjuster 10 is disk-like in shape and fits into yoke 11. It provides a hole 10B that is engaged by pin 12. In this manner the adjuster is attached to one handle of the pliers.

Figure 6:
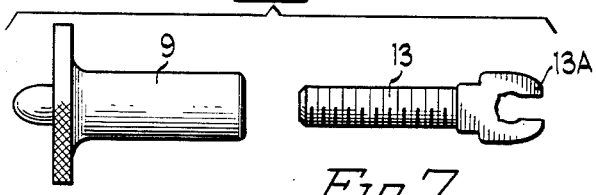

Variations of the expander unit may be employed. In FIG. 6, adjuster 13 has a fork 13A at its end that engages pin 12, but can be removed therefrom. This variation of the expander can be removed completely from the pliers, and then the pliers can function as a regular pair of pliers without being burdened by the expander.

Figure 7:
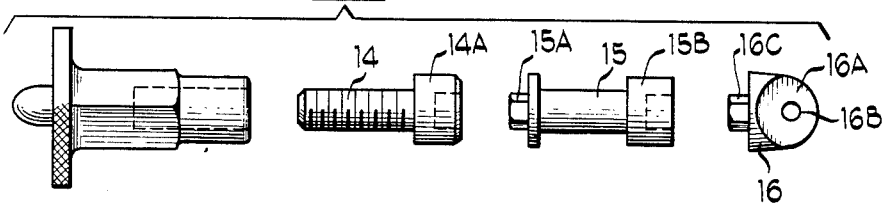

In FIG. 7, adjuster 14 has an Allen type screw head 14A at its end. In other words, 14 and 14A may be an ordinary Allen screw. Different length screws can provide various jaw openings. An extension bar 15 can be employed to further vary the jaw opening. Bar 15 has a male hex end 15A and a female hex end 15B. The expander variation of FIG. 7 requires a pin-yoke engaging unit 16 for its use. Unit 16 provides a disk end 16A that fits between the arms of yoke 11 (FIG. 2). Disk end 16A has a hole 16B in it that is engaged by pin 12. Male hex end 16C fits into the female hex end of either the Allen screw (14+14A) or the extension bar 15.

I claim:

1. Internal pliers comprising:

A. a pair of pliers having jaws suitable for internal gripping;

B. a pin-yoke attached to the inside of one handle of said pliers, the second handle having a notch in it toward the inside;

C. a pin passing through the pin-yoke; and

D. a removable expander means which comprises: a threaded adjuster having at one end a fork that is engaged by and removable from the pin that passes through the pin-yoke, and an internally-threaded thumbscrew having a rounded pin at its end that engages the notch in the pliers' handle, said thumbscrew screwing in and out on the threaded adjuster to adjust the spread of the pliers' handles.

2. The internal pliers of claim 1, further comprising a spring for tensioning the handles against the expander means.

3. Internal pliers comprising:

A. a pair of pliers having jaws suitable for internal gripping;

B. a pin-yoke attached to the inside of one handle of said pliers, the second handle having a notch in it on the inside;

C. a pin passing through said pin-yoke;

D. a pin-yoke engaging unit attached to the pin yoke, said engaging unit comprising: a disk end having a hole in it that is engaged by the pin-yoke pin, and a male hex end extending toward the other handle; and E. an expander means comprising: an Allen screw having a head that engages the male hex end of the pin-yoke engaging unit, and an internally-threaded thumbscrew having a rounded pin as its end that engages the notch in the pliers' handle, said thumbscrew in and out on the Allen screw to adjust the spread of the pliers' handles.

4. The internal pliers of claim 3, further comprising an extension bar that has a male hex end that engages the Allen screw and a female hex end that engages the pin-yoke engaging unit.

5. The internal pliers of claim 3, further comprising a spring for tensionioning the handles against the expander means.

* * * * *